US007383648B1

(12) United States Patent
Litchfield et al.

(10) Patent No.: US 7,383,648 B1
(45) Date of Patent: Jun. 10, 2008

(54) INFLATABLE SUPPORT SYSTEM FOR AN ARTICLE OF FOOTWEAR

(75) Inventors: Paul E. Litchfield, Westboro, MA (US); Geoff Swales, Somerset, MA (US)

(73) Assignee: Reebok International Ltd., Canton, MA (US)

( * ) Notice: Subject to any disclaimer, the term of this patent is extended or adjusted under 35 U.S.C. 154(b) by 127 days.

(21) Appl. No.: 11/062,747

(22) Filed: Feb. 23, 2005

Related U.S. Application Data

(60) Provisional application No. 60/546,188, filed on Feb. 23, 2004.

(51) Int. Cl.
*A43B 13/20* (2006.01)

(52) U.S. Cl. ..... 36/29

(58) Field of Classification Search ..... 36/29, 36/35 B, 153

See application file for complete search history.

(56) References Cited

U.S. PATENT DOCUMENTS

| | | | |
|---|---|---|---|
| 410,622 | A | 9/1889 | Houck |
| 508,034 | A | 11/1893 | Moore |
| 510,504 | A | 12/1893 | Foster |
| 545,705 | A | 9/1895 | MacDonald |
| 547,645 | A | 10/1895 | LaCroix |
| 566,422 | A | 8/1896 | Singleton |
| 580,501 | A | 4/1897 | Moberley |
| 586,155 | A | 7/1897 | Bascom |
| 836,364 | A | 11/1906 | Busby |
| 850,327 | A | 4/1907 | Tauber |
| 900,867 | A | 10/1908 | Miller |
| 1,069,001 | A | 7/1913 | Guy |
| 1,145,534 | A | 7/1915 | Wetmore |
| 1,148,376 | A | 7/1915 | Gay |
| 1,193,608 | A | 8/1916 | Poulson |
| 1,241,832 | A | 10/1917 | Drunkenmiller |
| 1,304,915 | A | 5/1919 | Spinney |
| 1,328,154 | A | 1/1920 | Jackerson |
| 1,383,067 | A | 6/1921 | Borman |
| 1,498,838 | A | 6/1924 | Harrison, Jr. |
| 1,605,985 | A | 11/1926 | Rasmussen |

(Continued)

FOREIGN PATENT DOCUMENTS

| | | |
|---|---|---|
| BR | 8305004 | 4/1985 |

(Continued)

OTHER PUBLICATIONS

Zonic Product Brochure, date unknown.

(Continued)

*Primary Examiner*—Ted Kavanaugh
(74) *Attorney, Agent, or Firm*—Sterne, Kessler, Goldstein & Fox P.L.L.C.

(57) ABSTRACT

An impact absorbing flexible support system, comprising a plurality of fluid filled chambers disposed in a plurality of longitudinal rows and a plurality of lateral rows, forming a matrix of said fluid filled chambers and an article of footwear containing such a flexible support system. Each chamber is fluidly connected to at least two other fluid filled chambers and has a vertically tapered shape to provide flexibility of movement. The support system is made from air tight thermoplastic film and is inflatable. The support system may have one or more larger fluid filled chamber is disposed amongst said matrix of chambers.

12 Claims, 8 Drawing Sheets

U.S. PATENT DOCUMENTS

| | | | | |
|---|---|---|---|---|
| 1,869,257 | A | | 7/1932 | Hitzler |
| 1,979,972 | A | | 11/1934 | Guild |
| 2,007,803 | A | | 7/1935 | Kelly |
| 2,020,240 | A | | 11/1935 | Cochran |
| 2,074,286 | A | | 3/1937 | Sullivan |
| 2,080,469 | A | | 5/1937 | Gilbert |
| 2,080,499 | A | | 5/1937 | Nathansohn |
| 2,090,881 | A | | 8/1937 | Wilson |
| 2,100,492 | A | | 11/1937 | Sindler |
| 2,177,116 | A | | 10/1939 | Persichino |
| 2,434,770 | A | | 1/1948 | Lutey |
| 2,468,886 | A | | 5/1949 | Lutey |
| 2,488,382 | A | | 11/1949 | Davis |
| 2,600,239 | A | | 6/1952 | Gilbert |
| 2,605,560 | A | | 8/1952 | Gouabault |
| 2,677,904 | A | | 5/1954 | Reed |
| 2,677,906 | A | | 5/1954 | Reed |
| 2,682,712 | A | | 7/1954 | Owsen et al. |
| 2,762,134 | A | | 9/1956 | Town |
| 2,863,230 | A | | 12/1958 | Cortina |
| 2,981,010 | A | | 4/1961 | Aaskov |
| 3,044,190 | A | | 7/1962 | Urbany |
| 3,100,354 | A | | 8/1963 | Lombard et al. |
| 3,120,712 | A | | 2/1964 | Menken |
| 3,469,576 | A | | 9/1969 | Smith et al. |
| 3,608,215 | A | | 9/1971 | Fukuoka |
| 3,716,930 | A | | 2/1973 | Brahm |
| 3,744,159 | A | | 7/1973 | Nishimura |
| 3,795,994 | A | | 3/1974 | Ava |
| 3,888,242 | A | | 6/1975 | Harris et al. |
| 4,008,530 | A | | 2/1977 | Gager |
| 4,123,855 | A | | 11/1978 | Thedford |
| 4,129,951 | A | | 12/1978 | Petrosky |
| 4,183,156 | A | | 1/1980 | Rudy |
| 4,211,236 | A | | 7/1980 | Krinsky |
| 4,217,705 | A | | 8/1980 | Donzis |
| 4,219,945 | A | | 9/1980 | Rudy |
| 4,263,728 | A | | 4/1981 | Frecentese |
| 4,271,606 | A | | 6/1981 | Rudy |
| 4,297,797 | A | | 11/1981 | Meyers |
| 4,312,140 | A | | 1/1982 | Reber |
| 4,340,626 | A | | 7/1982 | Rudy |
| 4,342,157 | A | | 8/1982 | Gilbert |
| 4,358,902 | A | | 11/1982 | Cole et al. |
| 4,397,104 | A | | 8/1983 | Doak |
| 4,446,634 | A | | 5/1984 | Johnson et al. |
| 4,458,430 | A | | 7/1984 | Peterson |
| 4,462,171 | A | | 7/1984 | Whispell |
| 4,471,538 | A | | 9/1984 | Pomeranz et al. |
| 4,486,964 | A | | 12/1984 | Rudy |
| 4,521,979 | A | * | 6/1985 | Blaser ..... 36/29 |
| 4,536,974 | A | | 8/1985 | Cohen |
| 4,546,556 | A | | 10/1985 | Stubblefield |
| 4,547,978 | A | | 10/1985 | Radford |
| 4,571,853 | A | | 2/1986 | Medrano |
| 4,577,417 | A | | 3/1986 | Cole |
| 4,593,482 | A | | 6/1986 | Mayer |
| 4,610,099 | A | | 9/1986 | Signori |
| 4,611,412 | A | | 9/1986 | Cohen |
| 4,662,087 | A | | 5/1987 | Beuch |
| 4,670,995 | A | | 6/1987 | Huang |
| 4,702,022 | A | | 10/1987 | Porcher |
| 4,744,157 | A | | 5/1988 | Dubner |
| 4,763,426 | A | | 8/1988 | Polus et al. |
| 4,768,295 | A | | 9/1988 | Ito |
| 4,779,359 | A | | 10/1988 | Famolare, Jr. |
| 4,799,319 | A | | 1/1989 | Zellweger |
| 4,817,304 | A | | 4/1989 | Parker et al. |
| 4,833,795 | A | | 5/1989 | Diaz |
| 4,845,861 | A | | 7/1989 | Moumdjian |
| 4,852,274 | A | | 8/1989 | Wilson |
| 4,856,208 | A | | 8/1989 | Zaccaro |
| 4,874,640 | A | | 10/1989 | Donzis |
| 4,887,367 | A | | 12/1989 | Mackness et al. |
| 4,906,502 | A | | 3/1990 | Rudy |
| 4,912,861 | A | | 4/1990 | Huang |
| 4,918,838 | A | | 4/1990 | Chang |
| 4,936,030 | A | | 6/1990 | Rennex |
| 4,991,317 | A | | 2/1991 | Lakic |
| 4,995,173 | A | | 2/1991 | Spier |
| 4,999,931 | A | | 3/1991 | Vermeulen |
| 5,005,300 | A | | 4/1991 | Diaz et al. |
| 5,005,575 | A | | 4/1991 | Geri |
| 5,014,449 | A | | 5/1991 | Richard et al. |
| 5,022,109 | A | | 6/1991 | Pekar |
| 5,025,575 | A | | 6/1991 | Lakic |
| 5,042,176 | A | | 8/1991 | Rudy |
| 5,113,599 | A | | 5/1992 | Cohen et al. |
| 5,131,174 | A | | 7/1992 | Drew et al. |
| RE34,102 | E | | 10/1992 | Cole et al. |
| 5,155,927 | A | | 10/1992 | Bates et al. |
| 5,179,792 | A | | 1/1993 | Brantingham |
| 5,195,257 | A | | 3/1993 | Holcomb et al. |
| 5,228,156 | A | | 7/1993 | Wang |
| 5,230,249 | A | | 7/1993 | Sasaki et al. |
| 5,235,715 | A | | 8/1993 | Donzis |
| 5,253,435 | A | | 10/1993 | Auger et al. |
| 5,255,451 | A | | 10/1993 | Tong et al. |
| 5,295,314 | A | | 3/1994 | Moumdjian |
| 5,311,674 | A | | 5/1994 | Santiyanont et al. |
| 5,313,717 | A | | 5/1994 | Allen et al. |
| 5,335,382 | A | | 8/1994 | Huang |
| 5,353,459 | A | | 10/1994 | Potter et al. |
| 5,363,570 | A | | 11/1994 | Allen et al. |
| 5,367,792 | A | | 11/1994 | Richard et al. |
| 5,375,346 | A | | 12/1994 | Cole et al. |
| 5,381,607 | A | | 1/1995 | Sussmann |
| 5,392,534 | A | | 2/1995 | Grim |
| 5,395,674 | A | | 3/1995 | Schmidt et al. |
| 5,406,719 | A | | 4/1995 | Potter |
| 5,416,986 | A | | 5/1995 | Cole et al. |
| 5,443,529 | A | | 8/1995 | Phillips |
| 5,545,463 | A | | 8/1996 | Schmidt et al. |
| 5,564,143 | A | | 10/1996 | Pekar et al. |
| 5,572,804 | A | | 11/1996 | Skaja et al. |
| 5,607,749 | A | | 3/1997 | Strumor |
| 5,625,964 | A | | 5/1997 | Lyden et al. |
| 5,625,965 | A | | 5/1997 | Bissett et al. |
| 5,664,341 | A | | 9/1997 | Schmidt et al. |
| 5,679,439 | A | | 10/1997 | Schmidt et al. |
| 5,701,687 | A | | 12/1997 | Schmidt et al. |
| 5,706,589 | A | | 1/1998 | Marc |
| 5,741,568 | A | | 4/1998 | Rudy |
| 5,755,001 | A | | 5/1998 | Potter et al. |
| 5,771,606 | A | | 6/1998 | Litchfield et al. |
| 5,784,807 | A | | 7/1998 | Pagel |
| 5,794,361 | A | | 8/1998 | Sadler |
| 5,802,739 | A | | 9/1998 | Potter et al. |
| 5,806,208 | A | | 9/1998 | French |
| 5,832,630 | A | | 11/1998 | Potter |
| 5,839,209 | A | | 11/1998 | Healy et al. |
| 5,842,291 | A | | 12/1998 | Schmidt et al. |
| 5,893,219 | A | | 4/1999 | Smith et al. |
| 5,896,681 | A | | 4/1999 | Lin |
| 5,915,820 | A | | 6/1999 | Kraeuter et al. |
| 5,916,664 | A | * | 6/1999 | Rudy ..... 428/178 |
| 5,930,918 | A | | 8/1999 | Healy et al. |
| 5,987,779 | A | | 11/1999 | Litchfield et al. |
| 6,014,823 | A | * | 1/2000 | Lakic ..... 36/93 |
| 6,158,149 | A | | 12/2000 | Rudy |
| 6,161,240 | A | | 12/2000 | Huang |
| 6,266,897 | B1 | | 7/2001 | Seydel et al. |
| 6,287,225 | B1 | | 9/2001 | Touhey et al. |
| 6,305,102 | B1 | | 10/2001 | Doyle |

| | | | | |
|---|---|---|---|---|
| 6,354,020 | B1 | 3/2002 | Kimball et al. | |
| RE37,705 | E | 5/2002 | Donzis | |
| 6,425,195 | B1 | 7/2002 | Donzis | |
| 6,453,577 | B1 | 9/2002 | Litchfield et al. | |
| 6,487,795 | B1 | 12/2002 | Ellis, III | |
| 6,505,420 | B1 | 1/2003 | Litchfield et al. | |
| 6,516,540 | B2 | 2/2003 | Seydel et al. | |
| 6,519,797 | B1 * | 2/2003 | Brubaker et al. | 5/654 |
| 6,519,873 | B1 | 2/2003 | Buttigieg | |
| 6,553,691 | B2 | 4/2003 | Huang | |
| 6,568,102 | B1 | 5/2003 | Healy et al. | |
| 6,584,706 | B1 | 7/2003 | Ellis, III | |
| 6,745,499 | B2 | 6/2004 | Christensen et al. | |
| D495,127 | S | 8/2004 | Marvin et al. | |
| 6,785,985 | B2 | 9/2004 | Marvin et al. | |
| 6,845,573 | B2 | 1/2005 | Litchfield et al. | |
| 2002/0121031 | A1 | 9/2002 | Smith et al. | |
| 2003/0046830 | A1 | 3/2003 | Ellis, III | |
| 2003/0208926 | A1 | 11/2003 | Ellis, III | |
| 2004/0003515 | A1 | 1/2004 | Marvin et al. | |
| 2004/0261293 | A1 | 12/2004 | Marvin et al. | |
| 2005/0120590 | A1 | 6/2005 | Ellis et al. | |

FOREIGN PATENT DOCUMENTS

| | | |
|---|---|---|
| CA | 1143938 | 4/1983 |
| CA | 1230225 | 12/1987 |
| DE | 820 869 | 11/1951 |
| DE | 28 00 359 | 7/1979 |
| DE | 32 45 182 | 5/1983 |
| EP | 0 095 357 | 11/1983 |
| EP | 0 301 331 | 2/1989 |
| EP | 0 629 360 | 12/1994 |
| EP | 0 630 592 | 12/1994 |
| EP | 0 714 613 | 6/1996 |
| FR | 720257 | 2/1932 |
| FR | 2452889 | 10/1980 |
| FR | 2614510 | 11/1988 |
| FR | 2663208 | 12/1991 |
| GB | 14955 | 0/1894 |
| GB | 338266 | 11/1930 |
| GB | 520514 | 4/1940 |
| GB | 817521 | 7/1959 |
| GB | 2085278 | 4/1982 |
| GB | 2114425 | 8/1983 |
| GB | 2165439 | 4/1986 |
| GB | 2201082 | 8/1988 |
| JP | 6-181802 | 7/1994 |
| WO | WO 87/03789 | 7/1987 |
| WO | WO 89/06500 | 7/1989 |
| WO | WO 89/10074 | 11/1989 |
| WO | WO 91/11931 | 8/1991 |
| WO | WO 91/16831 | 11/1991 |
| WO | WO 91/18527 | 12/1991 |
| WO | WO 93/12685 | 7/1993 |
| WO | WO 93/14659 | 8/1993 |
| WO | WO 95/20332 | 8/1995 |
| WO | WO 98/09546 | 3/1998 |
| WO | WO 01/19211 | 3/2001 |

OTHER PUBLICATIONS

Runner's World, pp. 58-59, 69 and 74 (Apr. 1991).

Brochure of the Nike Air Force 180 shoe, included with photographs of shoes on sale prior to Nov. 1993.

* cited by examiner

INFLATABLE SUPPORT SYSTEM FOR AN ARTICLE OF FOOTWEAR

This application claims priority to U.S. Provisional Application No. 60/546,188 which is incorporated herein by reference in its entirety.

BACKGROUND OF THE INVENTION

1. Field of the Invention

The field of this invention generally relates to footwear, and more particularly to an article of footwear having a system for providing cushioning and support for the comfort of the wearer.

2. Background Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole which absorbs shocks. However, the sole should also possess enough resiliency to prevent the sole from being "mushy" or "collapsing," thereby unduly draining the energy of the wearer.

In light of the above, numerous attempts have been made over the years to incorporate into a shoe means for providing improved cushioning and resiliency to the shoe. One concept practiced in the footwear industry to improve cushioning and energy return has been the use of fluid-filled devices within shoes. For example, U.S. Pat. Nos. 5,771,606, 6,354,020 and 6,505,420 teach such devices. These devices attempt to enhance cushioning and energy return by transferring a fluid between the area of impact and another area of the device. The basic concept of these devices is to have cushions containing fluid disposed adjacent the heel or forefoot areas of a shoe which transfer fluid to the other of the heel or forefoot areas. Several overriding problems exist with these devices.

One of these problems is that often the fluid filled devices are permanently embedded into the sole of the shoe and, therefore, not adjustable. For example, shoes can be made to adjust for the various lengths of feet, but it is impossible for the shoe industry to account for variations in the weight of the wearer. Further, it may be desirable to adjust the amount of cushioning and support for various activities such as running, biking, or casual walking. In addition, the level of performance may change the type of cushioning and support sought by the wearer. For example, an athlete may choose to have a different amount of support while training than while competing. Consequently, it is desirable to have the amount of air (or the pressure) within the sole be adjustable.

Adjusting fluids in the sole of footwear is known in the art of footwear design. For example U.S. Pat. No. 4,610,099 to Signori (the Signori patent) shows a shoe having an inflatable bladder in the sole. The Signori patent provides for the bladder to be inflated using a hypodermic needle insertion.

Another difficulty for shoe designers is to design one insert that is right for every foot. This task is almost impossible because the shape and contour of each foot and the way each foot applies pressure to the sole of a shoe varies dramatically. For example, because the heel is the first part of the foot to hit the ground during the typical-gait of a human, many designs show a large fluid filled chamber in the heel portion of an insert for harsh pressure forced downward by the heel. However, the shape of a heel is not the same for everyone nor is the way the heel provides pressure to the sole of a shoe. If the pressure from the heel does not hit the large fluid filled chamber in the right way, a consistent support is not provided. For example, if the heel lands on the sole slightly off-center, the heel chamber is limited in the way it can deform when the weight of the heel is pressed against it. Consequently, one large heel chamber will not provide proper support to each and every foot.

An additional problem with the shoe inserts formerly described is that in order to provide support, the insert often lacks flexibility. Large air filled bladders when fully inflated, have only a limited ability to longitudinally and laterally flex with the movement of the foot and/or shoe.

BRIEF SUMMARY OF THE INVENTION

In accordance with the purpose of the present invention as embodied and described herein, the present invention is a support and cushioning system disposed within the sole of an article of footwear. One embodiment of the invention is a support system having a plurality of fluid filled chambers. Each fluid filled chamber is fluidly connected to at least two other fluid filled chambers. These connected fluid filled chambers are preferably adjacent to one another. More preferably, the plurality of fluid filled chambers are disposed in a plurality of rows generally extending in a first direction and a plurality of rows generally extending along a second direction, forming a matrix of fluid filled chambers. In one embodiment, a connected row of fluid filled chambers may be disposed in the longitudinal direction (i.e. toe to heel) while another connected fluid filled chambers is disposed in the lateral direction (i.e. medial to lateral side), such that the lateral and longitudinal rows are interconnected. Alternatively, the connected fluid filled chambers may be disposed in other directions.

The fluid filled chambers of the support system have a vertically tapered shape. This tapered shape may be terraced or smooth. The tapered shape allows for the support system to be flexible in several directions.

The fluid filled chambers, preferably filled with air, may be at an ambient pressure or pressurized. Preferably, the fluid filled chambers are inflatable, via a permanently attached inflation mechanism. The inflation mechanism is fluidly connected to at least one fluid filled chamber, such as via at least one incoming fluid passageway. Alternatively, the inflation mechanism may be attached to two or more fluid filled chambers.

The fluid filled chambers may also include a deflation mechanism, which is permanently and fluidly connected to at least one fluid filled chamber, such as via at least one outgoing fluid passageway. The deflation mechanism may also be fluidly connected via two or more outgoing fluid passageways to one or more separate fluid filled chambers. The incoming and outgoing fluid passageways may be fluidly connected to the same fluid filled chambers.

The support system is made of a vacuum formed thermoplastic film, which is air tight. The support structure may be made in a unitary structure or by attaching one or more vacuum formed pieces together. The support system has a top surface and a bottom surface, wherein at least the top surface has taper shaped pockets extending in a vertical direction away from the bottom surface, forming the fluid filled chambers. The bottom surface may be horizontally flat or it may also have taper shaped pocket extending in an opposite vertical direction to the taper shaped pockets of the top surface, forming fluid filled chambers of double thickness.

The present invention also contemplates a shoe sole comprising the support system and an article of footwear comprising a sole and a support system having a plurality of fluid filled chambers wherein each chamber is fluidly connected to at least two other fluid filled chambers. The article of footwear may further comprise a midsole and an outsole. The outsole may have an upper surface with plurality of concave indentations therein for receiving the fluid filled chambers. Likewise, the midsole may have a lower surface with a plurality of concaved indentations therein for receiving said plurality of fluid filled chambers. Alternatively, the support system may be placed between two layers of said midsole or above said midsole.

The present invention also contemplates a flexible support system comprising a flexible insert generally having a shape equivalent to that of at least a portion of a sole of a shoe. The insert has a length generally extending in a longitudinal (i.e. heel to toe) direction of a sole of a shoe and a width generally extending across (i.e. from medial to lateral side) a sole of a shoe. In one embodiment the insert has a plurality of rows aligned along the width, wherein each row comprises a plurality of fluid filled chambers, such that the plurality of rows form a matrix of fluid filled chambers along a longitudinal direction. Each fluid filled chambers within the same row has substantially the same shape. This shape constitute a generally round or elliptical horizontal cross-section. All of the fluid filled chambers are fluidly interconnected.

In another embodiment, at least one row of fluid filled chambers may be interrupted by one or several larger fluidly connected fluid filled chamber, such that the larger fluid filled chamber is disposed amongst the matrix of chambers. Preferably, a first larger fluid filled chamber is encircled by a second larger fluid filled chamber disposed amongst the matrix of chambers.

The insert may corresponds generally to a heel portion, a forefoot portion or the entire sole of a shoe. Alternatively, the insert may comprises a heel portion that generally corresponds to a heel portion of a sole of a shoe and a forefoot portion that generally corresponds to a forefoot portion of a sole of a shoe, which are fluidly connected via one or more fluid passageways.

BRIEF DESCRIPTION OF THE DRAWINGS/FIGURES

DETAILED DESCRIPTION OF THE INVENTION

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Referring to FIGS. 1-5 and 7-8, a support system 102 is shown. Support system 102 provides continuously modifying cushioning to an article of footwear, such that the wearer's stride forces air within support system 102 to move in a complementary manner with respect to changes in pressure that occur during the stride.

Figure 1:
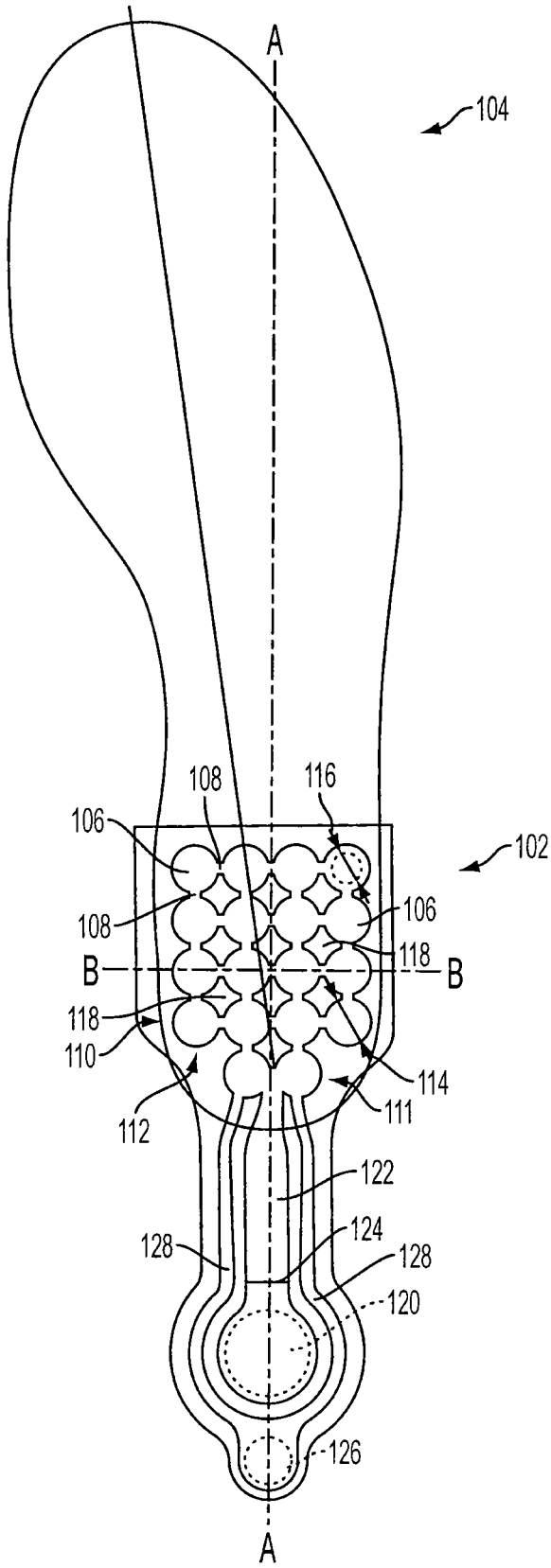
FIG. 1 is a top cross-sectional view of an embodiment of the present invention disposed only in the heel portion of an article of footwear.

FIG. 1 is a top cross-sectional view of an embodiment of the present invention disposed only in the heel portion of a sole 104. The support system comprises a plurality of chambers 106 arranged in a matrix. The chambers 106 are fluidly connected to at least two other chambers via fluid connectors 108. The fluid connectors 108 can be of any length or can merely be an opening in the base of one chamber which feeds directly into an opening in the base of an adjacent chamber.

During a typical gait cycle, the main distribution of forces on the foot shifts from the lateral side of the heel during the "heel strike" phase of the gait, then moves toward the medial side of the forefoot area during "toe-off." The configuration of the fluid connections ensures that the fluid flow within the support system complements such a gait cycle.

As pressure continues downward, the chambers 106 somewhat collapses causing the air pressure in those chambers 106 to increases with the decrease in volume of those chambers 106. Thus, the downward pressure resulting from heel strike causes fluid within the support system to be forced away from the portion of the matrix wherein the pressure is exerted to other fluidly connected chambers 106. Since chambers 106 are fluidly connected to at least two other chambers, the fluid pressure becomes equalized throughout the rest of the matrix.

The flow of fluid causes the remaining chambers 106 to expand, which slightly raises those areas of the foot. As the gait continues, the swelled chambers 106 help cushion the corresponding impact forces. The pressure of the foot gradually rolls along the longitudinal length of the support system. As the weight of the wearer is shifted to other portions of the matrix, the downward pressure on those chambers 106 forces fluid to be thrust through fluid connections 108 and to be equalized among the other areas of the matrix. The pressure in each chamber 106 is constantly being adjusted as the air migrates from the area of the matrix receiving pressure to the areas of the matrix that are not.

After "toe-off," no downward pressure is being applied to the matrix, so the fluid within the support system returns to its normal state. Upon the next heel strike, the process is repeated.

In light of the foregoing, it will be understood that the present invention provides a variable, non-static cushioning, in that the flow of fluid within the support system 102 complements the natural biodynamics of an individual's gait.

In the embodiment of FIG. 1, the matrix comprises a plurality of lateral rows 110 running across the width of the sole 104 and a plurality of longitudinal rows 112 running along the length of the sole 104. Each chamber 106 is fluidly connected to each adjacent chamber 106 in the longitudinal and lateral directions. The chambers 106 are arranged to follow the natural contours of the sole 104. For example, the first lateral row 111 closest to the heel comprises only two chambers. Consequently, if the support system 102 was extended along the entire length of the sole, a lateral row 110 may have more or less air filled chamber across the width of the sole 104 depending upon the width of the sole where that row is located. Similarly, additional chambers 106 may be added to the longitudinal rows 112 to extend the matrix across the entire length of the sole 104.

Figure 2A:
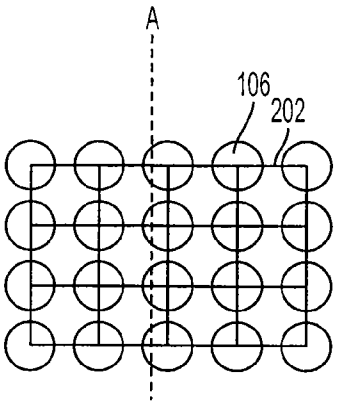
FIG. 2A shows the arrangement for fluid chambers and the connections there between of the embodiment shown in FIG. 1.
Figure 2B:
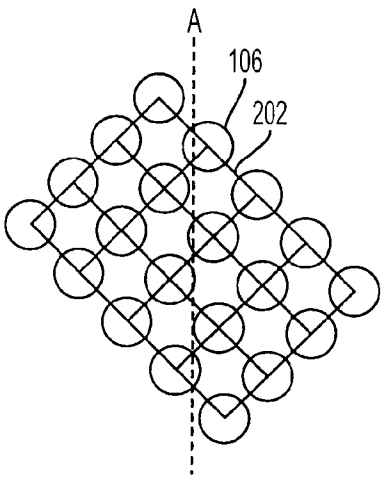
FIGS. 2B-2D are a few examples of alternative arrangements for fluid chambers and the connections there between of the present invention.
Figure 2C:
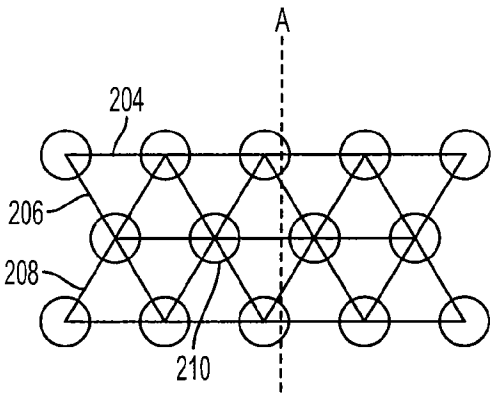
Figure 2D:
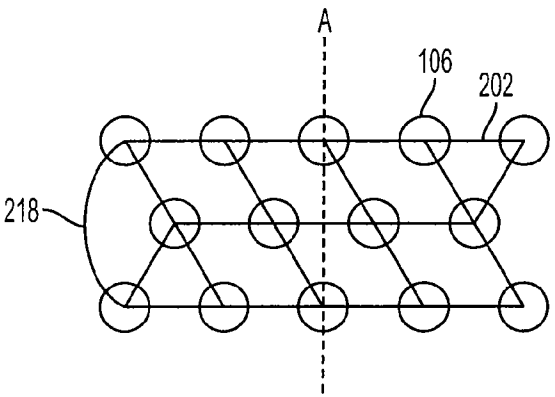

FIG. 2A shows an arrangement of chambers 106 that is similar to the arrangement shown in FIG. 1. FIGS. 2B-2D show a few of the many alternative arrangements of the matrix of the support system 102 of the present invention with respect to the toe to heel line A of FIG. 1. The lines 202 show the various directions in which each chamber 106 could be fluidly connected to an adjacent chamber 106. FIG. 2A shows a possible alignment of the chambers 106 similar to that of FIG. 1. FIG. 2B, shows an alternative embodiment, wherein the lateral rows 110 and the longitudinal rows 112 of FIG. 1 are turned at an angle, such that the rows are instead diagonal rows running in different directions across the sole 104. It is preferred to have diagonal rows in the forefoot of the sole 104 because the toes of the human foot are formed along a diagonal.

FIG. 2C shows a matrix where the chambers 106 are arranged with lateral rows out of phase with adjacent lateral rows. Chambers 106 in this arrangement have an additional row of adjacent chambers 106 and can be connected in three directions, one along a lateral row, as shown in line 204, one along a diagonal row, as shown in line 206, and one along an opposite diagonal row, as shown in line 208. A center chamber 210 may be fluidly connected to up to six adjacent chambers. However, FIG. 2D shows the same arrangement only with each chambers fluidly connected to the adjacent chambers 106 in each lateral row and fluidly connected to each chamber 106 in only one diagonal row. One skilled in the art may appreciate that the chambers can be fluidly connected in a wide variety of arrangements and still function as discussed below provided that each chamber 106 be fluidly connected to at least two other chambers 106. For example, one chamber 106 may be fluidly connected to another chamber 106 which is disposed in a lateral or longitudinal row that is not directly adjacent, or may be connected by a fluid connection 108 which is curved, as in fluid connection 218 if FIG. 2D. Further, more or less fluid connections to each chamber maybe made in lateral, diagonal and longitudinal directions.

Additionally, the support system 102 may be formed from more than one matrix arrangement placed in various places on the sole 104. For example, the matrix of FIG. 2A may be placed in the heel portion of the sole 104 (as seen in FIG. 1) and may be fluidly connected to the matrix of FIG. 2B placed in the forefoot portion of sole 104.

FIGS. 1 and 2A-2D show chambers having a round horizontal cross-section. One skilled in the art would appreciate that chambers 106 can be of a variety of shapes and sizes. For example, an embodiment shown in FIG. 9 has elliptical chambers 904 which can make up a different shaped matrix.

The more fluid connectors 108 through which the fluid in each chamber 106 can migrate, the better the fluid can flow throughout the matrix and the better support is given to the remaining portions of the foot. When the entire matrix is fluidly connected in several different directions, it becomes less likely that the pressure from the foot will cut off an area of the matrix from the rest of the matrix causing pressure to build in one portion of the matrix. A build up of pressure may cause the support system 102 to become uncomfortable for the wearer or damaged. Preferably, each chamber 106 is fluidly connected to each adjacent chamber 106 within the matrix such that the air in one chamber can flow in more than one directions when pressure is applied to that chamber 106.

Figure 3A:
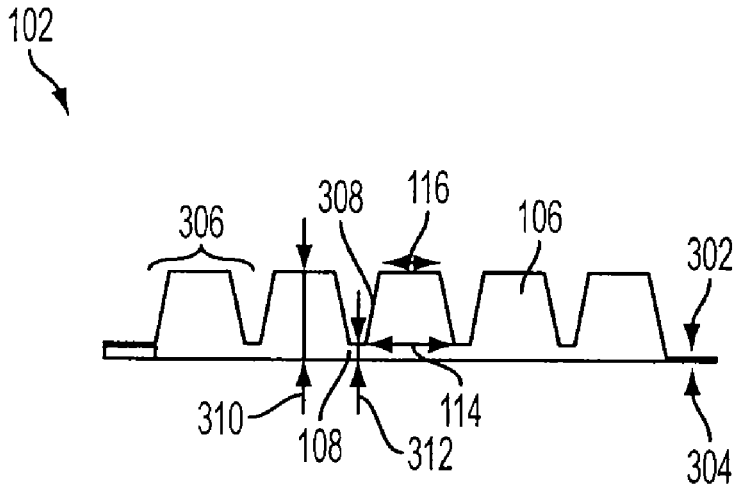
FIGS. 3A and 3B are possible a cross-sectional views along line B of FIG. 1.

FIG. 3A is a cross sectional view of the support system 102 along line B of FIG. 1. FIG. 3A shows the support system 102 having a top surface 302 and a bottom surface 304. In this embodiment, the bottom surface 304 is generally flat while the chambers 106 are created by vertical tapered pockets 306 formed in the top surface 302 of the support system 102. The tapered pockets 306 are created by angled walls 308 such that a base diameter 114 is larger than a surface diameter 116.

The diameters can be any size, depending on the number of chambers 106 that are used in the matrix. It is preferred, however, that the base diameter 114 be between about 10 and about 15 mm. Additionally, the angled walls 308 can be at any angle. However, it is preferred that the angled walls 308 come are about 10 to about 15 degrees from a vertical height 310. The vertical height 310 measured from the bottom surface 304 to the surface diameter 116 can be any amount depending upon the depth of the tapered pockets 306. Preferably the vertical height 310 is about 5 to about 15 mm.

The fluid connections 108 are formed where the top surface 302 is not adhered to the bottom surface 304 providing a second vertical height 312 which is substantially less than the vertical height 310 of the chambers 106. In all places other than the chambers 106 and fluid connectors 108, the top surface 302 is hermetically sealed to the bottom surface 304, preferably via RF welding, heat sealing or ultrasonic welding. For example, a cross-shaped seal 118 is formed among the chambers 106 and fluid connectors 108 of FIG. 1.

Figure 3B:
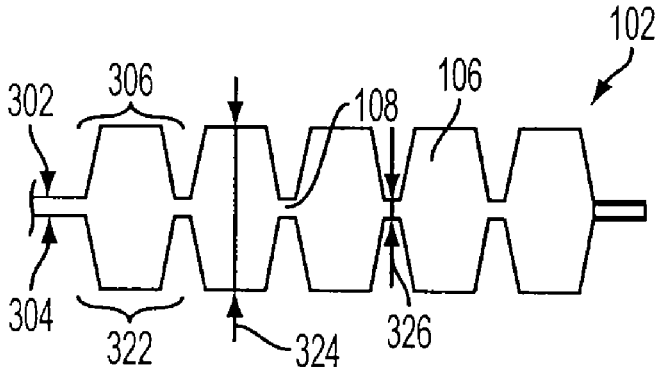

FIG. 3B shows an alternative cross sectional view of the support system 102 along line B of FIG. 1. This embodiment has chambers 106 formed by a top surface 302 comprising a plurality of tapered pockets 306 and a bottom surface 304 comprising a plurality of tapered pockets 322 which extend in the opposite vertical direction as those of the top surface 302. The tapered pockets 322 are identical to those described for the top surface 302 in FIG. 3A. Thus, the chambers 106 of the embodiment of FIG. 3B have a vertical height 324 which is double that of the vertical height 310 of the chambers 106 shown in FIG. 3A. Preferably, the vertical height 324 would be about 10 mm to about 30 mm.

Similarly, the fluid connectors 108 are formed identically to those described for FIG. 3A. Consequently, the fluid connectors 108 have a second vertical height 326 which is double the second vertical height 312 of the fluid connectors 108 shown in FIG. 3A.

Figure 4A:
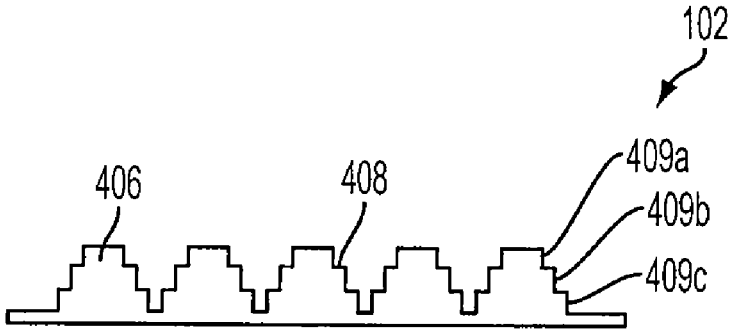
FIGS. 4A and 4B are alternative cross-sectional views along line B of FIG. 1.
Figure 4B:
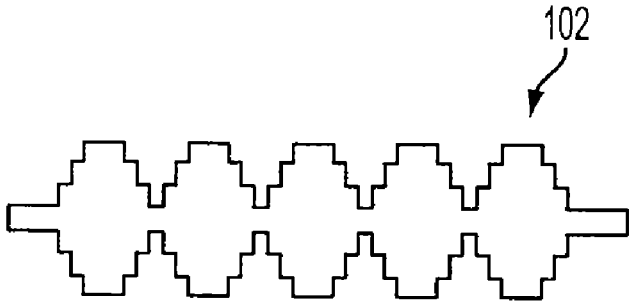

FIGS. 4A and 4B show alternative embodiments for the cross-sectional view along line B of FIG. 1. In this embodiment, tapered pockets 406 has terraced walls 408. Terraced walls 408 provide a bellowed effect to each of the chambers 106. Terraced walls 408 in FIGS. 4A and 4B have three terraced regions 409*a*, 409*b*, and 409*c*. However, one skilled in the art would understand that more or less terraced regions would be suitable in the present invention. For example, the forefoot region of FIG. 10 has chambers 106 with only two terraced regions.

Many materials within the class of fluid impervious Thermoplastic Elastomers (TPEs) or Thermoplastic Olefins (TPOs) can be utilized to form support system 102. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B.F. Goodrich under the tradename ESTANE, a lightweight urethane film such as is available from J.P. Stevens & Co., Inc. as product designation MP1880, and a TPU available from BASF under the tradename ELASTOLLAN provide the desirable physical characteristics. Additionally, support system 102 can be formed from natural rubber compounds.

The support system 102 can be formed by vacuum forming and sealing or thermoforming as sealing two thermoplastic films together. Alternatively, support system 102 can be formed by conventional injection molding or blow molding processes such that both pieces are formed at the same time in one unitary structure. Preferably, RF (radio frequency) welding is used to achieve an air tight seal leaving a volume of air within the support system 102. Alternatively, support system 102 may be formed by vacuum forming and sealing by heat welding or ultrasonic welding.

Support system 102 may comprise any fluid. Some embodiments may use a large molecule gas to avoid migration of the fluid out of the support system 102. Preferably, however, support system 102 contains air, the least expensive material. The chosen fluid may be at ambient pressure in support system 102. In another embodiment, the support system 102 may comprise a pressurized fluid in a sealed support system 102, although pressurized air will often diffused out of the support system 102 and over time the air in support system 102 will reach ambient pressure. In a preferred embodiment, however, the support system 102 is inflatable. An inflatable support system allows the wearer to adjust the levels of support the foot receives based on the wearer's individual needs. The level of support can be adjusted based on the type of activity, such as running, biking or casual walking, on the performance level desired, such as recreational, training, or competitive, or on other individual needs, such as weight variances of the wearer.

Nonetheless, the support system 102 of FIG. 1, is resilient enough to provide support even when not inflated, i.e., at ambient pressure because the vacuum formed top and bottom surfaces 302, 304 are sealed together leaving a volume between filled with air. The support system 102 does not flatten when the pressure is equalized with ambient conditions.

An inflatable support system 102 requires an inflation mechanism 120. One possibility is the use of an off-board inflation mechanism which is coupled with an external valve disposed in the sole of the article of footwear. Preferably, the support system 102 is fluidly connected to an on-board inflation mechanism 120, such as the one shown in FIG. 1. On-board inflation mechanism 120 provides for immediate adjustments without the need for additional equipment.

FIG. 1 shows an on-board inflation mechanism 120 fluidly connected to the two chambers 106 of lateral row 111 via an incoming air passageway 122. In this embodiment, inflation mechanism 120 is disposed towards the heel of the sole 104. One skilled in the art, however, will understand that the inflation mechanism 120 can be fluidly connected to any number of chambers 106 and disposed anywhere on the support system.

The inflation mechanism 120 may be any conventional type of on-board inflation mechanism. Preferably, inflation mechanism is small, lightweight, and provides a sufficient volume of air such that only little effort is needed for adequate inflation. For example, U.S. Pat. No. 5,987,779, which is incorporated by reference, describes an inflation mechanism comprising a bulb (of various shapes) with a check valve. When the bulb is compressed the check valve provides the air within the volume of the bulb be forced into the desired region. As the bulb is released, the check valve allows ambient air to enter the bulb.

Another inflation mechanism, also described in U.S. Pat. No. 5,987,779, is a bulb having a hole in it on top. A finger can be placed over the hole in the bulb upon compression. Therefore, the air, not permitted to escape through the hole, is forced into the desired location. When the finger is removed, ambient air is allowed to enter through the hole. U.S. Pat. No. 6,287,225 describes another type of on-board inflation mechanism suitable for the present invention involving a hidden plunger which moved air into the air bladder of a sports ball. One skilled in the art can appreciate that a variety of inflation mechanisms 120 are suitable for the present invention.

FIG. 1 shows a one-way valve 124 disposed between the inflation mechanism 120 and the chambers 106. The function of the valve 124 is to avoid air flowing back into the inflation mechanism 120. Various types of one-way valves 124 are suitable for use in the present invention. Preferably, the valve will be relatively small and flat for less bulkiness. U.S. Pat. No. 5,564,143 to Pekar describes a valve suitable for the present invention. The patent describes a valve formed between thermoplastic sheets. One skilled in the art would understand that a variety of suitable valves are contemplated in the present invention.

One embodiment, as seen in FIG. 1, may include a deflation valve 126 fluidly connected to support system 102. Deflation valve 126 allows the user to personally adjust the amount of air inserted into support system 102, particularly if the preferred comfort level is less than the pressure limits otherwise provided by support system 102. Deflation valve 126 may be a release valve. A release valve can be any type of release valve. One type of release valve is the plunger-type described in U.S. Pat. No. 5,987,779, incorporated herein by reference, wherein air is released upon depression of a plunger which pushes a seal away from the wall of support system 102 allowing air to escape. In particular, a release valve may have a spring which biases a plunger in a closed position. A flange around the periphery of the plunger can keep air from escaping between the plunger and a release fitting because the flange is biased in the closed position and in contact with the release fitting. To release air from support system 102, the plunger is depressed by the user. Air then escapes around the stem of the plunger. This type of release valve is mechanically simple and light weight. The components of a release valve may be made out of a number of different materials including plastic or metal.

As an alternative, deflation valve 126 may also be a check valve, or blow off valve, which will open when the pressure in support system 102 is at or greater than a predetermined level. In each of these situations, support system 102 will not inflate over a certain amount no matter how much a user attempts to inflate the shoe.

One type of check valve has a spring holding a movable seating member against an opening in the bladder. When the pressure from the air inside the bladder causes a greater pressure on the movable seating member in one direction than the spring causes in the other direction, the movable seating member moves away from the opening allowing air to escape the bladder. In addition, any other check valve is appropriate for use in the present invention, as would be apparent to one skilled in the art. For example, the VA-3497 Umbrella Check Valve (Part No. VL1682-104) made of Silicone VL1001M12 and commercially available from Vernay Laboratories, Inc. (Yellow Springs, Ohio, USA) may be a preferred check valve.

In another embodiment, deflation valve 126 may be an adjustable check valve, wherein a user can adjust the pressure at which a valve is opened. An adjustable check valve has the added benefit of being set to an individually preferred pressure rather than a factory predetermined pressure. An adjustable check valve may be similar to the spring and movable seating member configuration described in the preceding paragraph. To make it adjustable, however, the valve may have a mechanism for increasing or decreasing the tension in the spring, such that more or less air pressure, respectively, would be required to overcome the force of the spring and move the movable seating member away from the opening in the bladder. However, any type of adjustable check valve is appropriate for use in the present invention, as would be apparent to one skilled in the art, and any adjustable check valve would be appropriate for use in any embodiment of the present invention.

Support system 102 may include more than one type of deflation valve 126. For example, support system 102 may include both a check valve and a release valve. Alternatively, support system 102 may contain a deflation valve 126 which is a combination release valve and check valve. This type of valve is described in detail in U.S. Patent Application Publication No. 2004/0003515, which is incorporated herein in its entirety by reference.

In another embodiment, small perforations may be formed in support system 102 to allow air to naturally diffuse through the bladder when a predetermined pressure is reached. The material used to make support system 102 may be of a flexible material such that these perforations will generally remain closed. If the pressure in the bladder becomes greater than a predetermined pressure the force on the sides of the bladder will open the perforation and air will escape. When the pressure in support system 102 is less than this predetermined pressure, air will escape very slowly, if at all, from these perforations.

FIG. 1 shows a release valve 126 fluidly connected to the support system 102 via two outgoing air passageways 128. The outgoing air passageways 128 in the preferred arrangement of FIG. 1 are fluidly connected to the same two chambers 106 as incoming air passageway 122. Outgoing air passageways 128 run along opposite sides of the length of incoming air passageway 122 and around both sides of inflation mechanism 120. They then become fluidly connected to the release valve 126 such that the inflation mechanism 120 is disposed between the release valve 126 and the plurality of chambers 106. Nonetheless, one of ordinary skill in the art can appreciate that the release valve 126 can have any number of outgoing passageways. For example, a single passageway may fluidly connect the chambers 106 to the release valve 124.

The release valve 124 can be any conventional release valve. One type of release valve is the plunger type described in U.S. Pat. No. 5,987,779, wherein the air is released upon depression of a plunger which pushes a seal away from the wall of the bladder allowing air to escape. However, one skilled in the art can appreciate the utility of any type of release valve. Further, one skilled in the art can appreciate that inflation mechanism 120 and deflation mechanism 126 can be disposed on any portion of the shoe.

Figure 5:
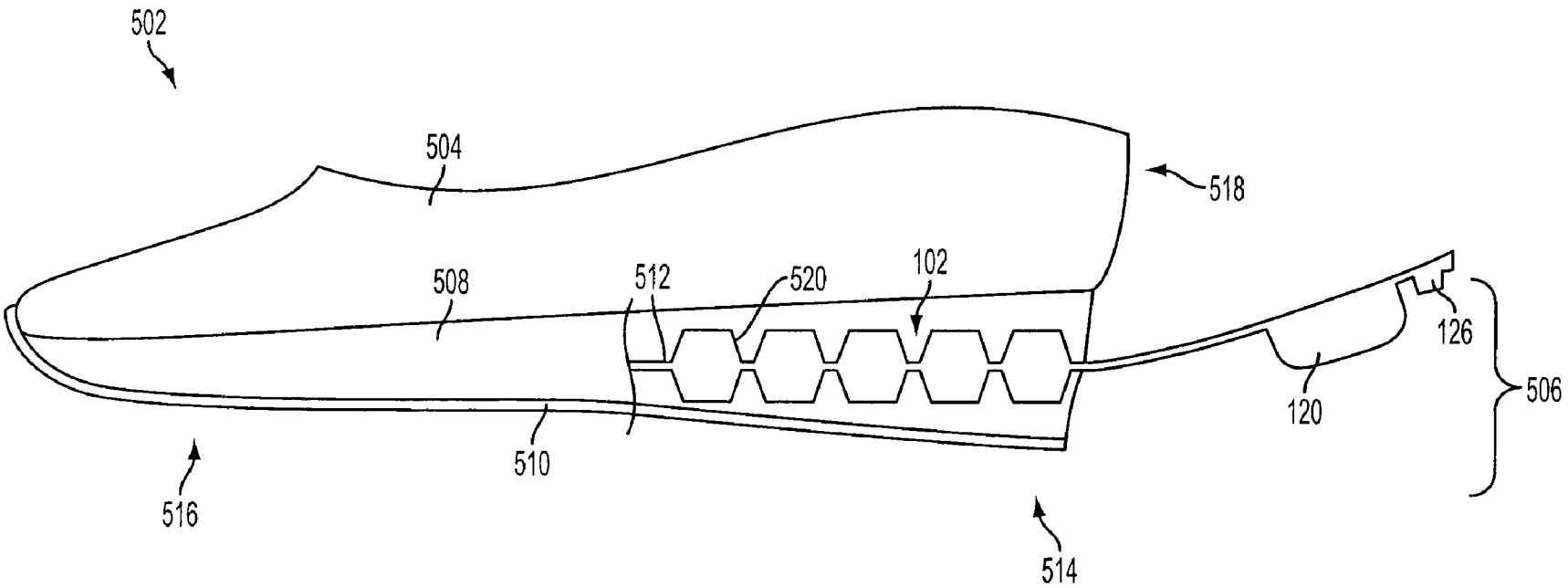
FIG. 5 is a cross-sectional longitudinal view of an article of footwear comprising a support system of the present invention.

An article of footwear comprising the support system 102 of the present invention will now be described. Referring to FIG. 5, an article of footwear 502 is shown comprising an upper 504 and a sole 506 comprising a midsole 508, and an outsole 510. Support system 102 is disposed within midsole 508. In FIG. 5, support system 102 is disposed only in heel portion 514 of article of footwear 502. Alternatively, support system 102 may be disposed in forefoot portion 516, or it may be extended along the entire length of article of footwear 502.

Inflation mechanism 120 and deflation mechanism 124 in FIG. 5 extends from heel portion 514 of sole 506. The inflation mechanism 120 and the deflation mechanism 124 of FIG. 5, therefore, may follow along the outside of sole 506 and attach to upper 504 at the heel area 518 of the article of footwear 502. However, the present invention contemplates inflation mechanism 120 placed anywhere on article of footwear 502 with an incoming air passage way 122 as long as needed to reach its location. Similarly, deflation mechanism 124 may be disposed on any part of the article of footwear with one or more outgoing passageways 128 as long as needed to reach its location. Preferably, however, the inflation mechanism 120 and the deflation mechanism 124 are disposed close to the sole, thus avoiding the weight and materials involved with having them disposed away from the support system 102.

Midsole 508 in FIG. 5 may be formed around the support system 102. Alternatively, the midsole 508 may be constructed such that the support system 102 is placed into an crevice 512 formed in midsole 508 having indentations 520 which receive chambers 106 of the support system 102. In another embodiment, the support system 102 may be disposed between a midsole 508 and an outsole 510 (not shown). In this embodiment, the midsole 508 may have a top surface and a bottom surface, wherein the bottom surface comprises a plurality of indentations which correspond to the shape of the chambers 106. The top surface 302 of the support system 102 is received by and adhered to the indentations of the midsole 508. Similarly, the outsole 510 may comprise a top surface and a bottom surface, wherein the top surface comprised indentation into which a portion of the bottom surface 304 of the support system 102 is receive and adhered. In this embodiment, a portion of the support system 102 may be visible between the midsole 508 and the outsole 510.

Any portion of either the midsole 508 or outsole 510 may have holes placed in it such that the support system 102 is visible. In another embodiment, a midsole 508 typically made out of ethyl vinyl acetate (EVA) or polyurethane (P.U.) may be replaced by an injection molded thermoplastic plate formed to incorporate support system 102 while outsole 510 is made from a resilient foam material. Support system 102 may be disposed between this thermoplastic plate and outsole 510 or may comprise a portion of the exterior of article of footwear 502.

Further, it will be appreciated by one skilled in the art that article of footwear 502 comprising support system 102 may be constructed so that the support system 102 is readily removable. Such an article of footwear 502 may be utilized without any support system 102 or may require the replacement of another support system. The support system 102 may also be made to stand alone or to be inserted above or just below a sock liner (or insole) in an article of footwear 502.

Figure 6:
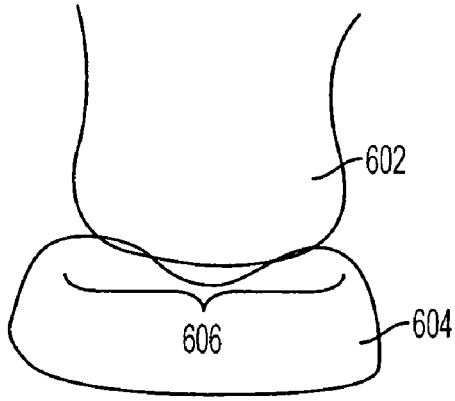
FIG. 6 PRIOR ART
FIG. 6 is cross-sectional lateral view of a heel compressing an air chamber of a known support system on center.
Figure 7:
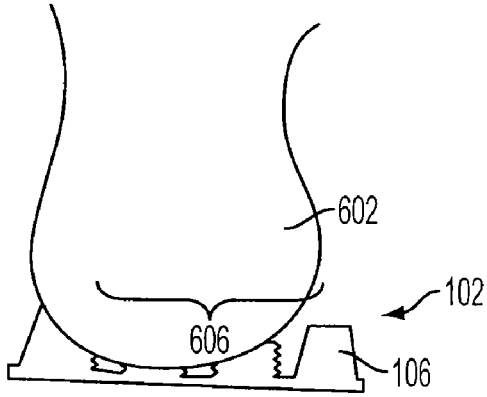
FIG. 7 is a cross-sectional lateral view of a heel compressing the fluid chambers of the present invention off center.

Most cushioning systems are designed with a large chamber or chambers to receive the pressure from various parts of the foot. For example, FIG. 6 shows a human heel 602 applying force to a large heel chamber 604 known in the art. A large chamber 604 is limited in how it can deform when pressure is applied. Thus, the heel 602 will only receive the best support if it hits large chamber 604 right in center part 606 of the cushion. In the present invention, as seen in FIG. 7, a heel 602 that hits off of center part 606 of support system 102 still receives excellent support because chambers 106 are small and deform independently of adjacent chambers 106. Consequently, no matter where a heel 602 falls on the matrix of chambers 106, it is supported.

Figure 8:
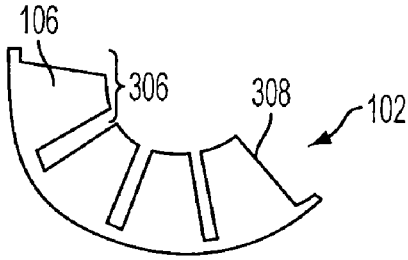
FIG. 8 is a longitudinal or lateral cross sectional view of a support system of the present invention when flexed.

Another advantage of support system 102 of the present invention is its flexibility. FIG. 8 shows a cross section similar to that of FIG. 3A, wherein the support system 102 is flexed. The angled walls 308 allow the support system to flex without the walls of one chamber 106 impeding its adjacent chamber 106. Although not shown, the embodiment of FIG. 3B may also be flexed such that the tapered pockets 306 of the top surface 302 are bent toward each other, as in FIG. 8, and the tapered pockets 322 of the of the bottom surface 304 are bent away from each other.

The flexibility provides that no matter how sole 506 is twisted or bent, support system 102 will not be damaged and will continue to provide support. In particular, the foot has a natural bend along the base of the toes, or metatarsal heads. The flexibility of support system 102 provides that a break or hinge in the support system 102 at this point is not necessary. Larger chambers, such as chamber 604 shown in FIG. 6, do not have such flexibility, particularly when inflated.

Figure 9:
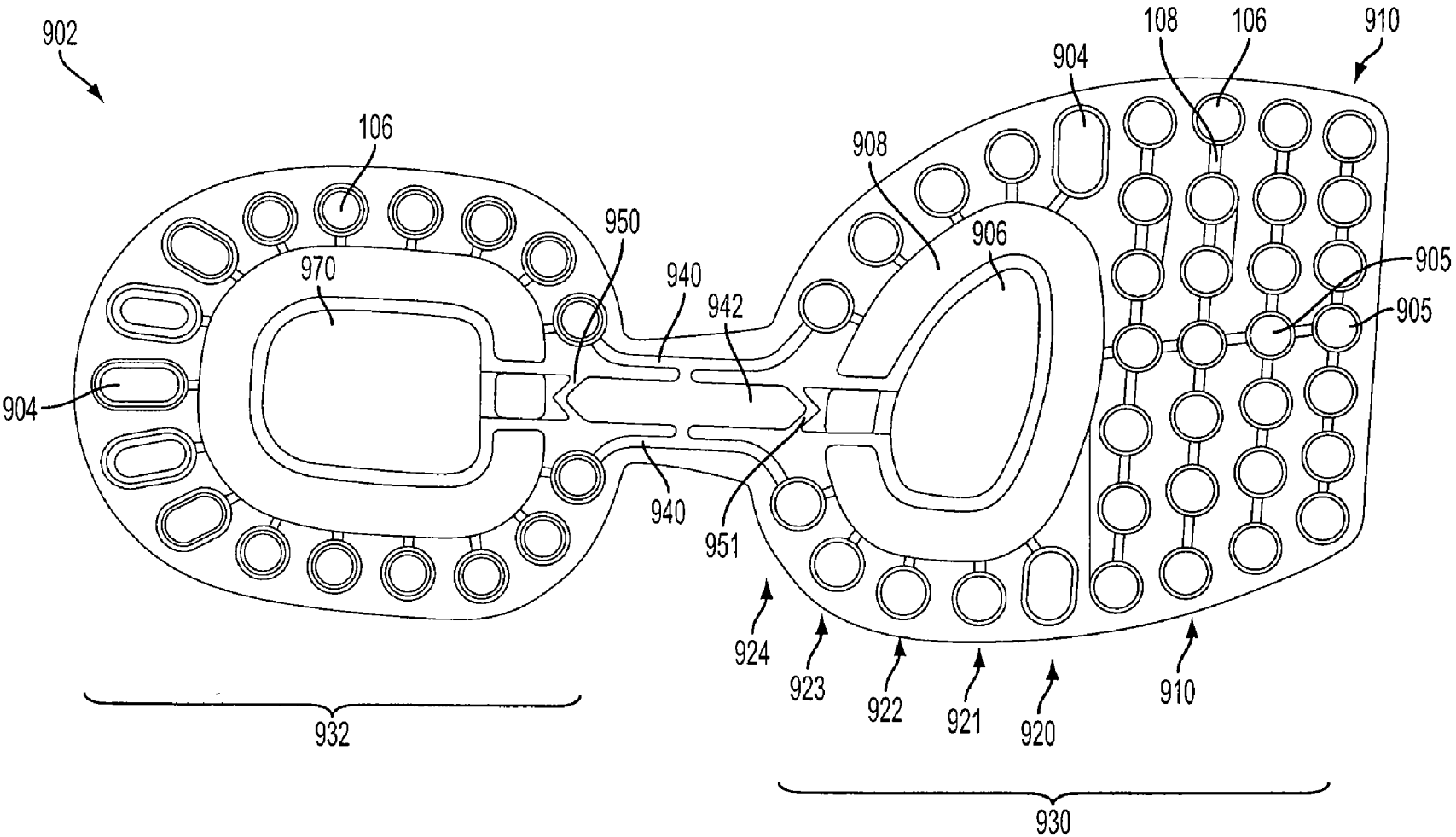
FIG. 9 is top plan view of an alternative embodiment of the present invention.
Figure 10:
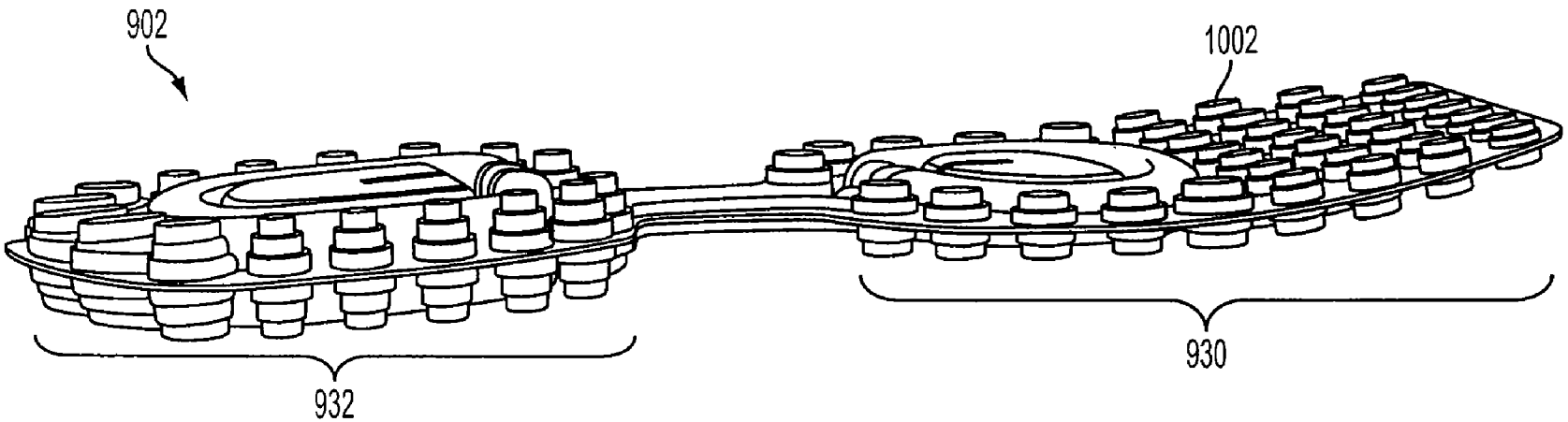
FIG. 10 is a side plan view of the embodiment shown in FIG. 9.

A support system of the type described above, may also be combined with a conventional support system to provide the advantages of having larger chambers with the flexibility provided by the matrix design. This type of embodiment of the present invention can be found in FIGS. 9 and 10. FIG. 9 shows a top plan view of support system 902 of the present invention. FIG. 10 shows a side plan view of support system 902 of FIG. 9. This embodiment also has a plurality of chambers 106 fluidly connected by fluid connections 108 arranged in lateral rows 910 across the width of the support system 902. However, in this embodiment, the chambers 106 are only fluidly connected to other chambers 106 in the same lateral row 910. A center chamber 905 in each row fluidly connects one lateral row 910 to an adjacent lateral row 910. FIG. 9 also shows that chamber 106 may not have only a round horizontal cross-section, but may also have an elliptical horizontal cross-section, as in elliptical chamber 904.

In this embodiment, one or more lateral rows may be interrupted by larger fluidly connected chambers. For example, lateral rows 920, 921, 922, 923 and 924 are interrupted by a first larger fluidly connected chamber 908 which encircles a second larger fluidly connected chamber 906. The larger fluidly connected chambers 908, 906 are thus disposed amongst the matrix of chambers 106, 904.

The larger chambers 908, 906 provide more cushioning for the foot, while the surrounding chambers 106, 904 allow for flexibility of the support system 902 and support for a foot if the foot does not squarely contact the larger chambers 908, 906.

Support system 902 shown in FIGS. 9 and 10 have a forefoot portion 930 and a heel portion 932, which are connected by two outer fluid passages 940 and an inner fluid passage 942. Inner fluid passage 942 contains either valves or impedance means 950 and 951 to control the amount of fluid that flows in and out of the larger chambers. One skilled in the art would appreciate that support system 902 may comprise only the forefoot portion 930 or the heel portion 932.

Support system 902 may be filled with any fluid at pressurized or ambient conditions or inflatable as described above for support system 102. Further, support system 902 may have a separate inflation means for inflating the interior larger sections 906 and 970 than the rest of the matrix, so that a different level of support can be provided in these areas.

It may be desirable for the wearer to inflate the left and right shoes to different pressures based on particular performance needs. However, it more probable that the wearer would choose to inflate both shoes to the same pressure, thereby getting equal support. Consequently, a pressure gage (not shown) which is also fluidly connected to the support system 102 may be employed to allow the wearer to determine when the resilient insert is inflated to the desired pressure, or a pressure equal to the resilient insert of the other shoe.

The foregoing description of the preferred embodiment, as shown in FIGS. 1-5 and 7-8, is presented for purposes of illustration and description. It is not intended to be exhaustive or to limit the invention to the precise form disclosed, and obviously many modifications and variations are possible in light of the above teachings. For example, it is not necessary that the support system 102, especially the plurality of chambers 106 and fluid connectors 108 be shaped as shown in the Figures. Chambers and fluid connections of other shapes may function equally as well. For example, instead of the chambers 106 in FIG. 1 appearing circular, they could be rectangular or any other shape. In other words, the tapered pockets 306 of FIGS. 3A and 3B have angled walls 308 that extend from a base which is dimensionally the same as a surface but scaled larger across the base 114 than across the surface 116.

In addition, FIG. 1 shows that the base diameters 114 of all the chambers 106 as uniform. The present invention also contemplates chambers 106 arranged in a matrix where not all of the chambers 106 have uniform dimensions. One skilled in the art can appreciate a matrix where strategically placed chambers may be larger or smaller in both circumference and vertical height than their adjacent chambers 106.

Further it can be appreciated that fluid mediums other than air can provide adequate support and movement in the support system 102 of the present invention, such as liquids and large molecule gases.

It is presumed that the preferred embodiment of the support system 102 of the present invention will find its greatest utility in athletic shoes (i.e., those designed for running, walking, hiking, and other athletic activities.)

While the invention has been particularly shown and described with reference to preferred embodiments thereof, it will be understood by those skilled in the art that various changes in form and details may be made therein without departing form the spirit and scope of the invention.

What is claimed is:

1. An impact absorbing support system for a sole of an article of footwear, comprising:

a plurality of fluidly connected inflatable chambers disposed in said sole, wherein three of said plurality of chambers are fluidly connected such that each of said three chambers is fluidly connected to the other two of said three chambers;

an inflation mechanism fluidly connected to at least one of said plurality of chambers via at least one incoming fluid passageway, wherein said incoming passageway is distinct from said inflation mechanism; and a deflation mechanism fluidly connected to at least one of said chambers via at least one outgoing fluid passageway, wherein said outgoing passageway is distinct from said deflation mechanism, wherein the incoming fluid passageway is different from the outgoing fluid passageway.

2. The support system of claim 1, wherein said plurality of chambers are disposed in a plurality of longitudinal rows extending in a longitudinal direction and in a plurality of lateral rows extending in a lateral direction, thereby forming a matrix of said chambers.

3. The support system of claim 1, wherein said inflation mechanism is permanently connected to at least one of said plurality of chambers.

4. The support system of claim 1, wherein at least one of said chambers has a vertically tapered shape.

5. The support system of claim 4 wherein said tapered shape is terraced.

6. The support system of claim 4, wherein said tapered shape is smooth.

7. The support system of claim 1, wherein said incoming fluid passageway is fluidly connected to two of said chambers.

8. The support system of claim 1, wherein said deflation mechanism is fluidly connected to at least one of said chambers via two outgoing fluid passageways.

9. The support system of claim 8, wherein said two outgoing fluid passageways are fluidly connected to two separate said chambers.

10. The support system of claim 1, wherein said support system has a top surface and a bottom surface, said top surface further comprising a plurality of taper shaped pockets extending in a vertical direction away from said bottom surface, wherein said chambers are formed between said top surface and said bottom surface.

11. The support system of claim 10, wherein said bottom surface is horizontally flat.

12. The support system of claim 10, wherein said bottom surface further comprises a plurality of taper shaped pockets extending in an opposite vertical direction to the taper shaped pockets of said top surface.

* * * * *